United States Patent [19]

Fahnders et al.

[11] Patent Number: 4,654,929

[45] Date of Patent: Apr. 7, 1987

[54] HINGE RE-BUILD ASSEMBLY

[76] Inventors: Jesse L. Fahnders; Barbara A. Fahnders, both of 1206 S. 18th St., Pekin, Ill. 61554

[21] Appl. No.: 898,975

[22] Filed: Aug. 22, 1986

[51] Int. Cl.[4] ..... E05D 5/00

[52] U.S. Cl. ..... 16/261; 16/245; 16/361; 7/100; 254/104; 384/626

[58] Field of Search ..... 16/261, 235, 237, 238, 16/245, 246, 247, 350, 357, 361, 362, 364, 262, 263, 387, 386; 254/104; 7/100; 384/626; 296/146

[56] References Cited

U.S. PATENT DOCUMENTS 1,794,798 3/1931 Sarr ..... 254/104

*Primary Examiner*—Nicholas P. Godici
*Assistant Examiner*—G. M. Reid
*Attorney, Agent, or Firm*—Henderson & Sturm

[57] ABSTRACT

Disclosed is a hinge repair assembly for correcting wear in the lower hinge of an automotive vehicle door, which wear occurs because of extended opening and closing of the door, with the result that the hinge pin hole (or holes) in the lowermost hinge ear (or ears) becomes ovalized and the door sags out of alignment with its striker and latching plates. The repair assembly includes a bearing block that is insertable in the space between the door ears and between the door edge and the hinge pin. The block is an upright groove that receives and forms a bearing surface for the hinge pin and a pair of ramp-faced members lying one at each side of the block and cross-connected screws which, when tightened, cause the block to ride forwardly on the ramp faces of the members to improve the bearing relation of the block to the hinge pin and restoring the hinge pin to its original position forwardly in the ovalized hole.

4 Claims, 6 Drawing Figures

HINGE RE-BUILD ASSEMBLY

BACKGROUND AND SUMMARY OF THE INVENTION

In many automotive vehicles, especially those of the two-door type, the lower hinges wear to such an extent that the door sags and interferes with easy closing of the door because the striker and latching elements have become vertically offset, requiring that the door be lifted to aline the parts just noted. Sagging is the result of wear in the lower hinge to such an extent that the hinge pin hole becomes "ovalized" and, if the situation is not corrected, the sagging simply increases. This problem exists mainly with the smaller low- and medium-priced automobiles and in the lower hinge area only.

According to the present invention, the problem is solved and sagging of the door eliminated by a novel re-build assembly in which a block of suitable bearing material is inserted between the lower hinge ears and intermediate the hinge pin and proximate door edge. The block has a forwardly opening U-shaped groove which receives and forms a bearing surface of substantial area for the hinge pin. Cam or ramp means is provided, including screws, which, when tightened, exert a forward force on the block to improve its bearing relationship to the hinge pin. The forward force acts between the hinge pin and the ovalized hole in the lower hinge ear, and the block replaces the worn holes(s) as the bearing for the hinge pin. Because the nature of block is such that it is almost completely wear-resistant, sagging of the repaired door is virtually eliminated.

It is a feature of the invention to provide an assembly which will restore the original integrity and function of the worn hinge and to utilize in the assembly a simple compact design consisting of relatively few parts that may be easily assembled, adjusted, dismantled and possessing long life.

Further features and advantages will become apparent as a preferred embodiment of the invention is disclosed in detail in the ensuing description and accompanying sheet of drawings.

DESCIPTION OF THE DRAWINGS

DESCRIPTION OF A PREFERRED EMBODIMENT OF THE INVENTION

Figure 3:
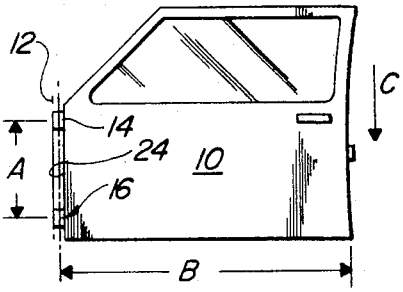
FIG. 3 is a small-scale view of a typical vehicle door.
Figure 4:
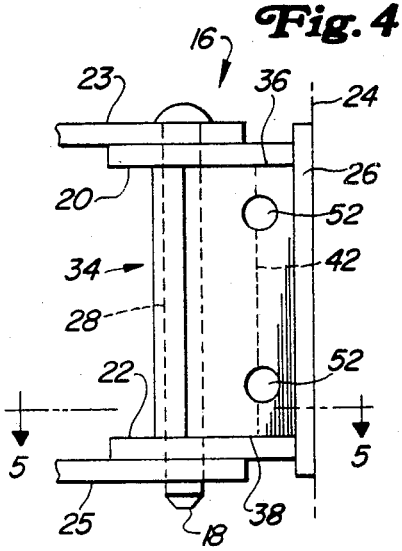
FIG. 4 is an elevation of the assembly installed in a hinge.
Figure 5:
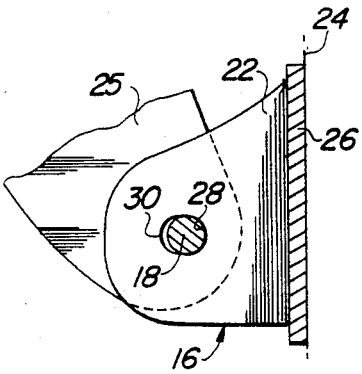
FIG. 5 is a section on the line 5—5 of FIG. 4 showing the ovalized state of the hinge pin hole in the lower ear of the door hinge in a worn condition prior to installation of the repair assembly and with the weight of the open door supported by the door hinges.
Figure 6:
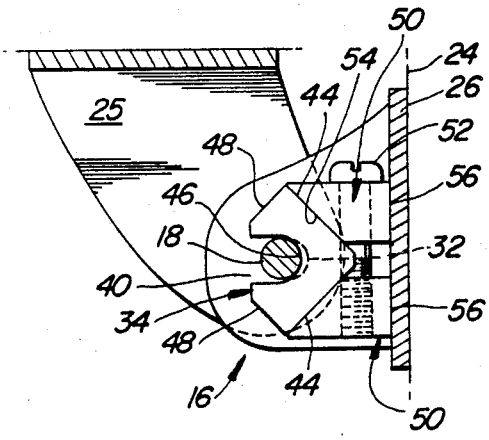
FIG. 6 is a view showing the hinge assembly in place and correcting for the ovalized hinge pin hole in the lower door hinge ear.

Reference will be had first to FIG. 3 for a brief explanation of the problem and what is required to correct it according to the invention. A typical automobile door is shown at (10) as being hinged to a vehicle body part (12) by means of upper and lower hinges (14) and (16), respectively, for swinging conventionally about a generally upright axis established by typical hinge pins, that for the lower hinge (16) being designated at (18) (FIGS. 4–6). In the usual construction, especially in a two-door vehicle, the vertical distance A between the upper and lower hinges is substantially less than the distance B between the hinge axis and the rear edge of the door, meaning that the weight of the door creates a substantial over-turning moment in the direction of the arrow C. Consequently, the lower hinge is subjected to fairly rapid wear, especially on the driver's side of the vehicle. This wear will be reflected in ovalizing of the hinge pin hole and consequent sagging of the door generally about the upper hinge as a "pivot".

The foregoing result of wear is depicted in FIG. 5, wherein the hinge (16) is shown as having upper and lower vertically spaced apart ears (20) and (22) (the upper ear appearing in FIG. 4). These ears interfit respectively with upper and lower ears (23) and (25) rigidly affixed in vertically spaced apart relation to the proximate body part or door post (12). The door ears may be welded directly to the proximate door edge (24) or may be welded to a plate (26) which is in turn welded to the door edge. In any event, these are substantial equivalents and reference to the function of the repair assembly to the door edge will be to the door edge as such, whether or not including the plate (26). The hinge pin (18) typically interconnects the several ears and is fixed to the body ears so that the door hinge ears swing on the pin.

FIGS. 5 and 6 best illustrate the wear and corrected conditions with respect to the hinge-receiving opening or hole in the lower hinge ear in particular, wherein the hole in general is designated at (28) and ovalizing is shown as a "crescent" at (30) (in somewhat exaggerated fashion for clarity). The condition shown in that in which the door is open and, because of prolonged usage and wear, is sagging about the upper hinge as a "pivot". In order to close the door, an upward force is required to aline the door latch parts with the body latch parts; that is, the sag must be overcome by manually lifting the door during closing movement (or by violent slamming) to shift the ear rearwardly via the ovalized hole so that the worn crescent appears to the rear of the hinge pin, as seen in dotted lines at (32) in FIG. 6. This figure also shows how the re-build assembly corrects for hinge hole wear by restoring the original relationship between the hinge pin and the hinge pin hole, particularly in the lower ear; although, the assembly will correct any similar wear in the upper ear of the lower hinge.

Figure 1:
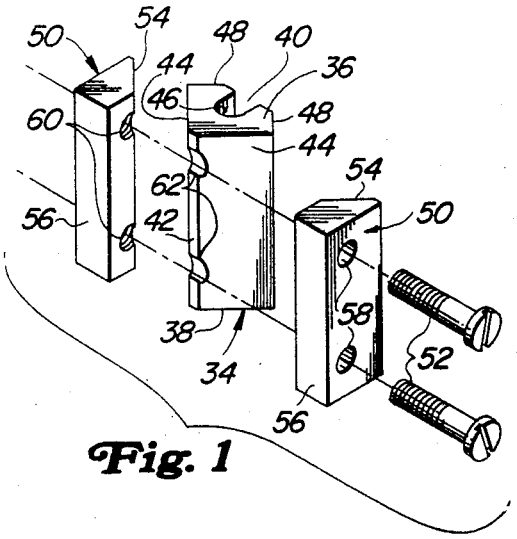
FIG. 1 is an "exploded" perspective of the assembly.
Figure 2:
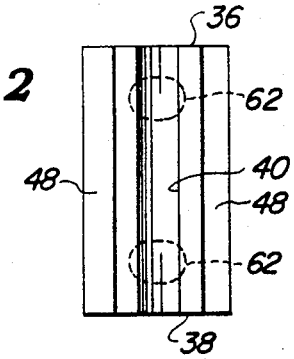
FIG. 2 is a front elevation of the bearing block.

The assembly, shown in "exploded" fashion in FIG. 1, comprises a bearing block (34) of suitable material having long-wearing qualities as a bearing, such as hard wood, various types of plastics, metal and the like. The block may be considered elongated in a vertical direction, which is its orientation in use, and its dimensions are such that it will fit between the ears of the lower hinge (FIG. 4) and between the hinge pin and the proximate edge of the door (also shown in FIG. 4). The block has top and bottom ends (36) and (38), respectively, a front portion which is formed with a vertical U-shaped groove (40) and a rear portion in the form of an apex (42) from which opposite ramp faces (44) diverge forwardly and outwardly in flanking relation to an intermediate part of the block in which the groove, being open toward the front of the block, terminates in a closed, rounded bottom (46) configured with a semi-cylindrical shape to receive and at least partly embrace the hinge pin (18) from the rear. The angle between the ramp faces may be 90°; although, this may be varied. In order to facilitate introduction of the block into the hinge without dismantling or otherwise modifying the hinge, the block has tapered portions respectively flanking the groove and diverging rearwardly (again at 90° to each other) from approximately the front margins of the groove. This reduces the "bulk" of the block so that it can be easily slipped into place from the side when the door is open, being easily turned after initial insertion to achieve its final position as seen in FIGS. 4 and 6; that is with the groove engaging the hinge pin (18) and the apex of the block toward the proximate door edge. The door should be open and blocked up during installation of the assembly in order to attain the FIG. 6 status.

Additional parts of the assembly are a pair of wedge members or plates (50) and a pair of screws (52). The plates are assembled respectively at opposite sides of the rear part of the hinge-pin-receiving block, and each plate has a ramp face (54) configured according to the associated ramp face on the block, the plates being mirror images of each other. Each plate has a rear edge portion (56) which abuts the proximate door edge (FIG. 6). One plate has spaced bores (58) for receiving the screws and the other plate has tapped bores into which the screws are respectively threaded to draw the plates together and thus, via the cooperative ramp faces, to force the block forwardly, reacting against the door-part-engaging wedges or plates, to cause the bearing block groove to restore the hinge pin and hinge pin hole(s) to their original status. The screws are inserted from the interior side of the door where the hinge is fully exposed. The apex part of the block has notches (62) to accommodate the screws (52). The bearing block thus forms a new and better bearing for the lower hinge and provides a long-wearing, inexpensive solution to the sagging door problem. After the block is inserted and the plates installed and the screws tightened, the blocks below the door of course are removed.

Features and advantages of the invention, not specifically pointed out herein, will become apparent to those versed in the art, as will many modifications in the preferred embodiment disclosed.

We claim:

1. For use in the re-building of a hinge of the type mounting a vehicle door to a vehicle body part for horizontal swinging, wherein the body part has a pair of vertically spaced apart horizontal ears interfitting with a pair of vertically spaced apart ears affixed to the proximate edge of the door and a vertical hinge pin spanning and interconnecting the door and body part ears and spaced forwardly of the door edge: a hinge repair assembly comprising a block of bearing material having top and bottom ends and front and rear upright portions and dimensioned to fit between the door ears and between the door edge and hinge pin, the front portion having an U-shaped bearing groove open toward the front of the block and running from top to bottom for receiving and said U-shape terminates in a closed, rounded bottom with a semicircal shape such that said U-shaped groove partly embracing the hinge pin from its rear, the rear portion of the block being V-shaped in section as seen from above and having an apex forming said block's rear most end and a pair of ramp faces diverging forwardly from the apex, a pair of wedge members disposed in laterally spaced apart relation with the block between them and respectively having ramp faces diverging from rear to front on the order of and respectively engaging the block faces, and further respectively having rear edge portions abutting the proximate edge of the door, and screw means disposed crosswise of the block and wedge members and cross-connecting the members to clamp them together and thus to exert a forward force on the block to improve the bearing engagement between the groove and the hinge pin.

2. The assembly of claim 1, in which the rear portion apex has a crosswise notch therein in crosswise alinement with and for accommodating the screw means.

3. The assembly of claim 2, including a pair of similar screw means and a pair of similar notches in the block and respectively accommodating the screw members.

4. The assembly of claim 1, in which the front portion has front-to-rear sloping faces respectively flanking the groove and diverging rearwardly respectively toward and meeting the block ramp faces.

* * * * *